US006173867B1

(12) United States Patent
Meyer

(10) Patent No.: US 6,173,867 B1
(45) Date of Patent: Jan. 16, 2001

(54) INSTALLATION FOR CONVEYING A LIQUID AND USE OF THE INSTALLATION

(75) Inventor: Thomas Meyer, Haemikon (CH)

(73) Assignee: Robatech AG, Muri (CH)

( * ) Notice: Under 35 U.S.C. 154(b), the term of this patent shall be extended for 0 days.

(21) Appl. No.: 09/253,753

(22) Filed: Feb. 22, 1999

(30) Foreign Application Priority Data

Mar. 13, 1998 (CH) ..... 0615/98

(51) Int. Cl.[7] ..... B67D 5/52; B67D 5/46; B05B 9/04; B05C 11/10

(52) U.S. Cl. ..... 222/255; 222/383.3

(58) Field of Search ..... 222/255, 383.3

(56) References Cited

U.S. PATENT DOCUMENTS

| | | | | |
|---|---|---|---|---|
| 2,734,667 | * | 2/1956 | Conklin | 222/255 |
| 3,906,122 | | 9/1975 | Krause et al. | 427/33 |
| 4,682,711 | * | 7/1987 | Reighard et al. | 222/255 |
| 4,690,308 | | 9/1987 | Cavanaugh et al. | 222/156 |
| 4,829,609 | | 5/1989 | Debrunner | 4/603 |
| 5,299,713 | * | 4/1994 | Saitoh | 222/255 |

FOREIGN PATENT DOCUMENTS

| | | |
|---|---|---|
| 3639122 | 11/1987 | (DE) . |
| 0273677 | 7/1988 | (EP) . |
| 9804358 | 2/1998 | (WO) . |

* cited by examiner

*Primary Examiner*—J. Casimer Jacyna
(74) *Attorney, Agent, or Firm*—Browdy and Neimark

(57) ABSTRACT

An installation (10) for conveying a liquid from a container (12) to a carrier material (45, 47). The installation (10) comprises a conduit system with two parallel conduit branches (24, 26). A conveying pump (14, 16) is arranged in each conduit branch (24, 26), and each conduit branch (24, 26) leads to a dispensing head (34, 36). At least one dispensing pump (14) is an intermittently operating pump, in particular a piston pump, while the second conveying pump (16) can be a pump of any arbitrary construction, in particular a continuously operating pump, for example a gear pump. The installation (10) can be used for conveying liquids of various, also temperature-dependent viscosities, such as an adhesive, for example.

9 Claims, 6 Drawing Sheets

INSTALLATION FOR CONVEYING A LIQUID AND USE OF THE INSTALLATION

FIELD OF THE INVENTION

The invention relates to an installation for conveying a liquid from a container to a dispensing head via a conduit system consisting of two parallel conduit branches, each one of which has a conveying pump. The invention further relates to the use of the installation.

BACKGROUND OF THE INVENTION

Within the scope of this specification, liquids are understood to be low- and high-viscosity liquids of all types, and in particular also liquids whose viscosity is a function of the temperature to a high degree.

Installations of the type mentioned at the outset, by means of which liquids can be conveyed from a container to one or several dispensing stations, are for example employed in machines for the application of adhesives. Adhesives, as well as other pastes, such a dyes, products used in the food industry and materials processed in the chemical industry, which have comparatively high viscosities, are often processed at temperatures which differ from the ambient temperature. They are conveyed via conduit systems with rigid and/or flexible conduits, which can be cooled or heated, to dispensing heads and are dispensed by the latter to a carrier material at the dispensing stations.

For example, in many cases it is necessary to dispense continuous ribbons of liquid to the carrier material, which is in an endless form or in the form of directly successive material sections and is conducted past the dispensing heads. In other cases there is the requirement of providing several application locations of the same carrier material with the same liquid wherein, depending on the occasion, either continuous liquid ribbons or liquid beads limited in length are to be created.

To generate pressure in the conduit systems it is possible to employ intermittently operating pumps, such as piston pumps, or continuously operating, or respectively rotating, pumps, such as gear pumps.

Gear pumps convey in a volumetric manner and are therefore mainly suitable for the chronologically constant dispensation of liquids, for example of continuous liquid ribbons on carrier materials. If a carrier material is to be provided with a liquid only in sections, the associated dispensing head must release the liquid intermittently, so that the dispensed liquid forms a plurality of liquid beads, which are spaced apart and whose length is limited, instead of an endless ribbon of liquid. An increased amount of liquid is dispensed at the start of each dispensation period because of the sluggishness of the installations and of the properties of the gear pumps, which results in that the liquid beads being generated have an excess of liquid at the start, which is unwanted in many cases.

In contrast to volumetrically conveying gear pumps, double-acting reversible piston pumps are purely pressure-generating systems. In the course of dispensing a liquid, the piston moves in such a way that the pressure drop occurring because of the dispensation of liquid is always compensated. As long as the associated installation does not dispense liquid, the piston does not move and the piston pump does not convey liquid. It is obvious that piston pumps are particularly suited to the intermittent dispensing of liquids, because they always dispense chronologically limited amounts of liquid during the respective dispensing periods, so that the liquid beads being created in the process do not have increased starting sections, but instead are even over their lengths. Neither the length of the dispensing periods nor their chronological spacing have any effects on this behavior. On the other hand, because of their intermittent operation, installations with a piston pump are not suitable for creating continuous ribbons of liquids.

OBJECT AND SUMMARY OF THE INVENTION

It is the object of the invention to create an installation of the type mentioned at the outset, by means of which it is possible either to dispense an even, continuous liquid ribbon at a dispensing station, or a series of liquid beads, which are limited in length, at a first dispensing station and, at a second dispensing station, a continuous liquid ribbon or a further series of liquid beads, which are limited in length, and propose a use for this installation.

Thus, the installation in accordance with the invention always has two conveying pumps, wherein at least one of these two conveying pumps is a piston pump, while the other one of the two conveying pumps can be of any arbitrary type of construction. A dispensing head is assigned to each conveying pump, through which the liquid to be dispensed is dispensed to the carrier material. The dispensing head assigned to the piston pump dispenses the liquid in the form of a series of faultless, length-limited liquid beads. It is therefore possible to employ two different pumps with different characteristics in an installation with only one container, because of which the possibility of solving a plurality of problems in the area of the conveyance and dispensation of liquid is obtained with a small outlay of apparatus.

An installation in accordance with the invention, wherein the second pump is a gear pump, is suitable for dispensing faultless, length-limited liquid beads or intermittent spraying at a first dispensing station by means of the dispensing head assigned to the piston pump, and of even continuous ribbons of liquid or continuous spraying at a second dispensing station by means of the dispensing head assigned to the gear pump.

Installations of this type with a piston pump and a gear pump are employed, for example, in the packaging industry and in the graphic industry, where it is required, for example, to provide a carrier material continuously with a liquid in the form of an adhesive, wherein it is necessary to create two lateral ribbons of liquid and, in addition, intermittently length-limited liquid beads. The latter need not be absolutely elongated, but can also be very short, for example in the shape of circles.

In the health-care industry it is possible by means of installations comprising a piston pump and a gear pump, to perform the intermittent dispensation of liquid beads of an adhesive for the lateral strip fixation, and the continuous dispensation of liquid ribbons for the fixation of cellulose on a carrier material made of polyethylene.

The insulation industry is a further example of the use of installations with a piston pump and a gear pump. A fine, continuously sprayed application of a liquid consisting of an adhesive is made by means of a dispensing head, which is connected to a branch conduit with a gear pump. At the same time an intermittent dispensation of length-limited liquid beads of an adhesive to the edge foil, which must not be continuously provided with an adhesive, takes place from a dispensing head connected to a branch conduit with a piston pump.

In connection with many applications it is useful to employ installations with two piston pumps. It is possible by means of such installations to create an almost continuous ribbon of liquid by a suitable, or respectively chronologically offset, reversal of the piston pumps. The two piston pumps are locked in relation to each other, preferably electronically. In this case it is possible to combine the portion of the conduit system arranged downstream of the piston pumps into a collecting conduit, to which a single dispensing head is connected or wherein, if desired, a further dispensing head is connected via a second conduit branch. An installation, wherein the reversing of the piston pumps does not result in a pressure drop, is obtained when using two piston pumps with the same gear ratio and the same conveying characteristics.

However, in an installation containing two piston pumps and separate conduit branches or a collecting conduit, it is also possible to dispense respectively one series of length-limited liquid beads at two dispensing stations. The piston pumps used for this can be designed and controlled in the same way or differently If a collecting conduit is provided, a conduit for a further dispensing head needs to be branched off.

An example for installations with two piston pumps is provided in connection with the use of robots, for example in the automobile or packaging industry. When employing robots, the situation often arises that a robot arm with a carrier material, on which a liquid, for example an adhesive, is to be dispensed, passes several dispensing heads at different speeds. In this case it may be necessary for the individual dispensing heads to be operated at different pressures, wherein these pressures should be individually controllable. Installations with several piston pumps are suitable for this purpose, wherein these piston pumps can be designed to be the same or different, depending on the requirements.

In the packaging industry, installations with two piston pumps and two dispensing stations can also be used for gluing by means of the so-called "wrap-around" method. In this case there is the problem that the dispensation of liquid in the form of an adhesive takes place at a considerably higher speed for the lateral gluing than the one for gluing the industrial bracket. Since the result of this is that the setting, or respectively the equalization of the entire machine is very difficult, it is of great advantage if the liquid dispensations can be separately regulated, wherein it is possible to provide different piston pumps for the two conduit branches leading to the dispensing heads.

It was shown to be advantageous in many areas of application to employ piston pumps with contactless electronic reversing, which is distinguished by its particularly low-pulsation behavior during switching.

The installations so far described basically have two conduit branches, each with a conveying pump. However, in many cases expanded installations are needed, which have at least one further conduit branch also containing a conveying pump and a dispensing head.

It is also possible for conduits to branch off from one or all conduit branches, each one of which leading to a dispensing head.

The conduit system can consist of rigid conduits, but in view of a varied employment of the installation, conduit systems are generally installed which mainly consist of flexible conduits.

In connection with preferred uses of the installation, the pasty material consists of a glue, and in many cases the pasty material is used at temperatures which differ from the ambient temperatures and which lie above or below the ambient temperatures.

The invention will be extensively described in what follows by means of exemplary embodiments of the installation in accordance with the invention, making reference to the drawings.

DETAILED DESCRIPTION OF THE PREFERRED EMBODIMENTS

Figures 1A, 1B, 1C, 1D:
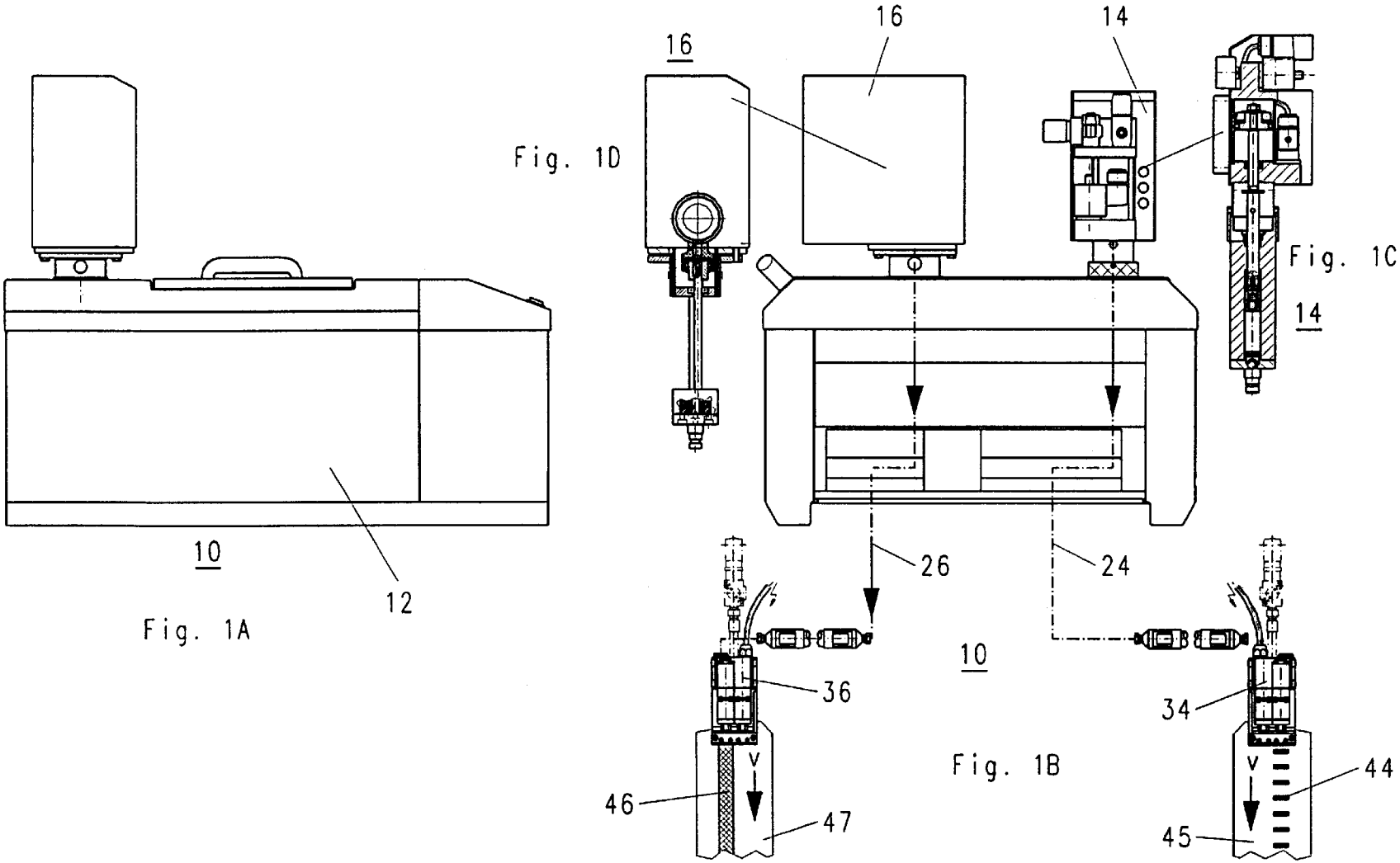
FIG. 1A represents in a simplified lateral view a first installation in accordance with the invention, having a piston pump and a gear pump.
FIG. 1B shows the installation represented in FIG. 1A from the front.
FIG. 1C represents the piston pump of the installation in accordance with FIG. 1B.
FIG. 1D represents the gear pump of the installation in accordance with FIG. 1B.

The installation 10 represented in FIGS. 1A and 1B has a lower portion 12 with a container 12 for the liquid to be conveyed and two conveying pumps, wherein in accordance with the invention the first conveying pump is a piston pump 14. The second pump which, in accordance with the invention, can be a member of any arbitrary type of pump, is a gear pump 16 in the present exemplary embodiment. The piston pump 14, which is shown in greater detail in FIG. 1C, is connected with a first dispensing head 34 via a first conduit branch 24 of a conduit system, and the gear pump 16, which is shown in greater detail in FIG. 1D, is connected with a second dispensing head 36 via a second conduit branch 26 of the conduit system. FIG. 1B furthermore shows the manner in which the dispensing of the liquid takes place. The dispensing head 34, which is connected with the piston pump 14, dispenses the liquid in the form of length-limited liquid beads 44 onto an area of the carrier material 45, which moves past the dispensing head 34 at a suitable speed, represented by an arrow v. In the present case the liquid beads 44 are of such short length that their width is greater than their length, however, it is also possible to dispense longer liquid beads or those with other distances from each other. The dispensation of liquid from the dispensing head 36, which is connected with the gear pump 16, takes place continuously in the form of a ribbon of liquid 46 on an area of a carrier material 47. The areas of the carrier materials 45 and 47 can be arranged integrally on the same material or on different objects.

Figure 2B:
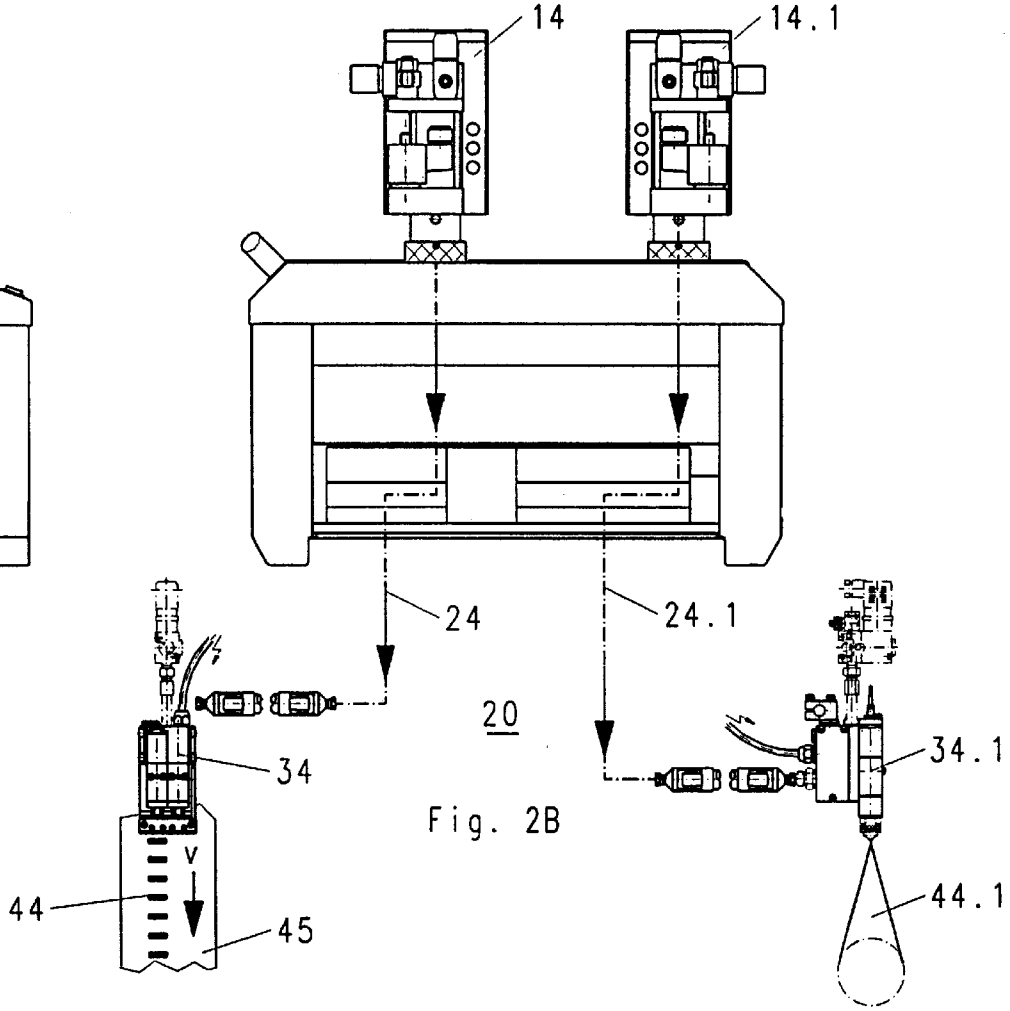
FIG. 2B shows the installation represented in FIG. 2A from the front.
Figure 2A:
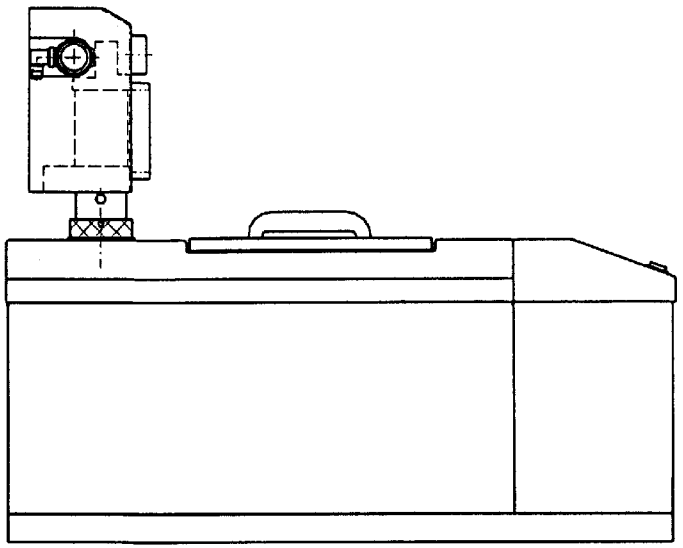
FIG. 2A represents in a simplified lateral view a second installation in accordance with the invention, having two piston pumps.

The installation 20 represented in FIGS. 2A and 2B is designed similarly to the installation 10 in accordance with FIGS. 1A to 1C, but a second piston pump 14.1 is provided as the second conveying pump. The construction and/or the control of the piston pumps 14 and 14.1 can be the same or different. The second conduit branch 24.1, to which the further piston pump 14.1 is connected, leads to a dispensing head 34.1, which dispenses the liquid by intermittent spraying 44.1.

Figure 3:
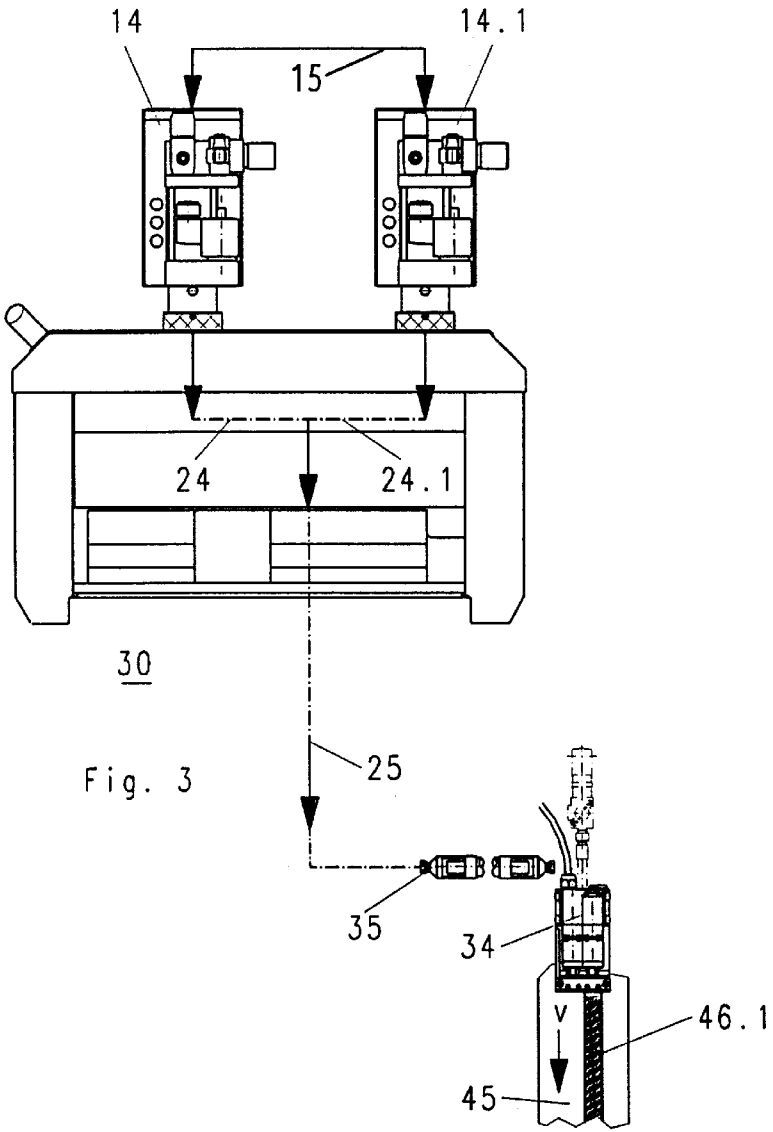
FIG. 3 represents a simplified view from the front of a third installation in accordance with the invention with two piston pumps, which dispense a continuous ribbon of liquid.

A further installation 30 is represented from the front in FIG. 3 and also has a piston pump 14 and a further piston pump 14.1. The conduit branches 24 and 24.1 of the two piston pumps 14, or respectively 14.1, are combined into a collecting conduit 25, to which a dispensing head 35 is connected. The piston pumps 14, 14.1 are constructed, arranged and, as indicated by their connection 15, controlled in such a matched way, that the liquid is dispensed in the form of a quasi-continuous ribbon of liquid 46.1 to a carrier material 45. This liquid ribbon 46.1 is called quasi-continuous, because it is composed of length-limited ribbons of liquid from the dispensing head 35, which are alternatingly created by the two piston pumps 14, 14.1, whose reversal takes place with a chronological offset for this purpose.

Figure 4:
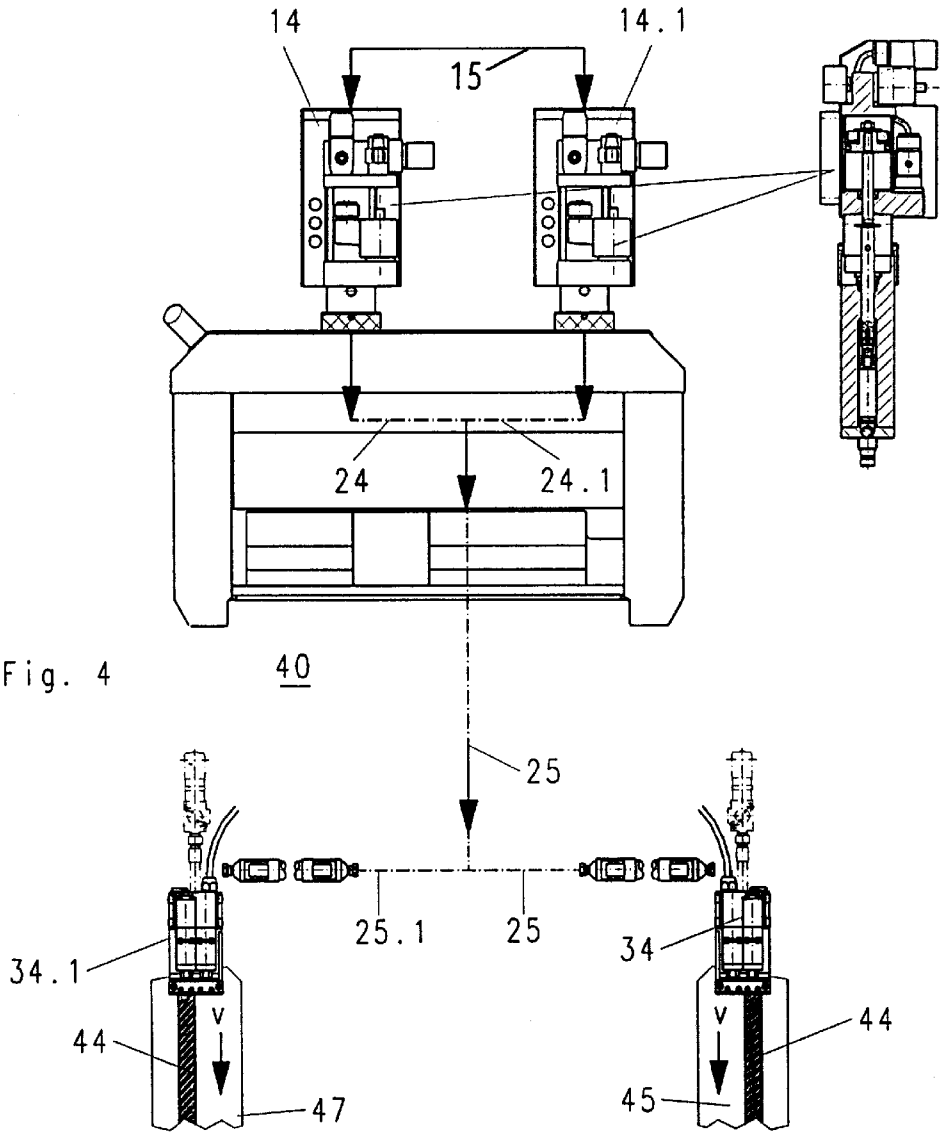
FIG. 4 represents a simplified view from the front of a third installation in accordance with the invention with two piston pumps, which dispense two series of length-limited liquid beads.

FIG. 4 shows an installation 40, which is basically constructed the same as the installation 30 of FIG. 3, but with the difference that there are two dispensing heads 34, 34.1, wherein the further dispensing head 34.1 is arranged in a conduit branch 25.1, which is separated from the collecting conduit 25. Each one of the dispensing heads 34, 34.1 dispenses the liquid in the form of quasi-continuous liquid ribbons 44 on two carrier materials 45, 47, or respectively two areas 45, 47 of a carrier material. Each liquid ribbon 44 is composed of length-limited liquid beads, which are alternatingly created by the two piston pumps 14,14.1.

Figure 5:
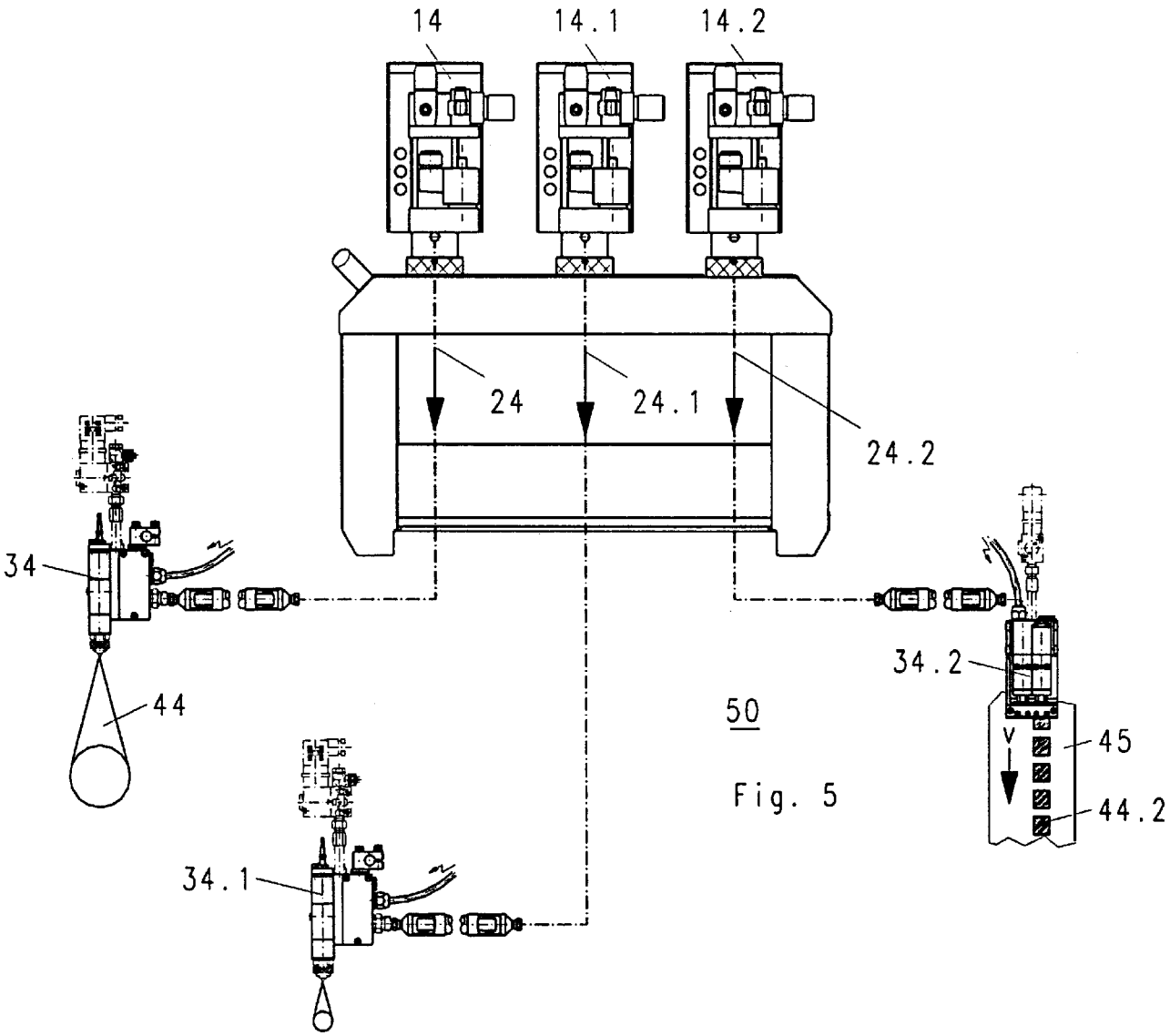
FIG. 5 represents a simplified view from the front of a third installation in accordance with the invention with three piston pumps, with three dispensing heads.

The installation 50 represented in FIG. 5 has, besides the piston pump 14 and the further piston pump 14.1, a third piston pump 14.2 as an additional conveying pump. Each one of the three piston pumps 14, 14.1, 14.2 is connected by means of its own conduit branch 24, or respectively 24.1, or respectively 24.2, with its own dispensing heads 34, or respectively 34.1, or respectively 34.2. Dispensing of the liquid on a carrier material 45 takes place in the form of a first intermittent spray 44 through the dispensing head 34, in the form of a second intermittent spray 44.1 through the dispensing head 34.1, and in the form of length-limited liquid beads 44.2 through the dispensing head 34.2.

Figure 6:
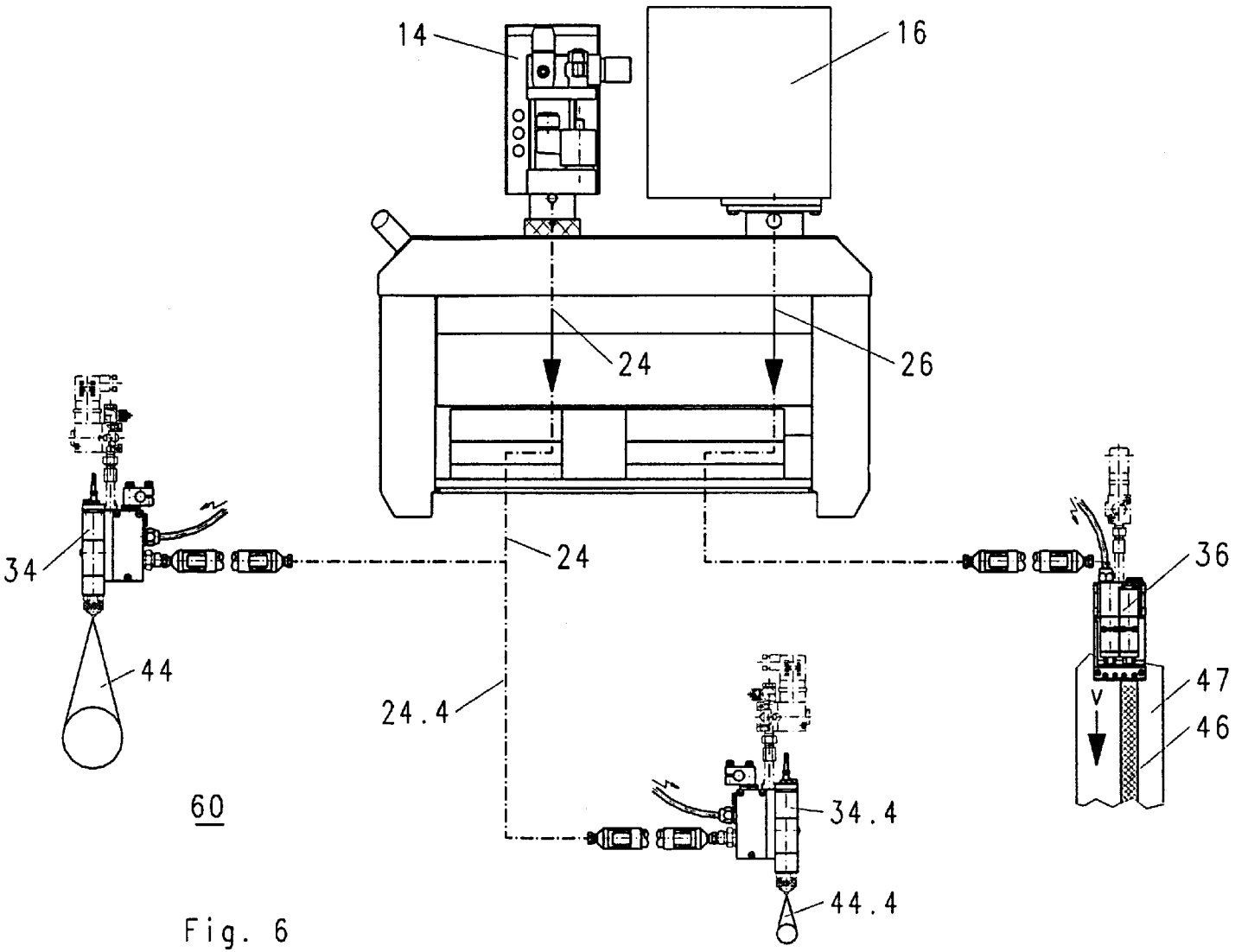
FIG. 6 represents a simplified view from the front of a third installation in accordance with the invention with a piston pump and a gear pump, with three dispensing heads.

FIG. 6 shows an installation 60 with a piston pump 14 and a gear pump 16. The piston pump 14 conveys the liquid through the conduit branch 24 to the dispensing head 34. A conduit branch 24.4 turns off the conduit branch 24, which is connected to a further dispensing head 34.4. The dispensing heads 34 and 34.4 dispense the liquid in the form of different intermittent sprays 44, or respectively 44.4. The gear pump 16 conveys the liquid through the conduit branch 26 to the dispensing head 36, where the liquid is dispensed on the carrier material 47 in the form of a continuous liquid ribbon 46.

The above described exemplary embodiments represent only a very limited selection of the installations which can be constructed in accordance with the invention.

What is claimed is:

1. An installation for conveying liquid from a container to dispensing heads which is adapted to dispense the liquid onto at least one carrier, said installation comprising:

a container;

a conduit system having a first conduit branch leading from the container to a first dispensing head;

a second conduit branch leading from the container to a second dispensing head;

a first conveying pump along said first conduit branch;

a second conveying pump along said second conduit branch;

said pumps comprising intermittently operating pumps;

wherein said installation is free of means for providing an electrical potential between the liquid and the carrier.

2. The installation (30, 40) in accordance with claim 1, characterized in that the two piston pumps (14, 14.1) can be reversed with a chronological offset in such a way that the conduit system is always charged with pressure.

3. The installation (50) in accordance with claim 2, characterized in that the conduit system has at least one further conduit branch (24.2) with a further conveying pump (14.2) and a further dispensing head (34.2).

4. The installation (20, 50) in accordance with claim 1, characterized in that the intermittently operating pumps are piston pumps (14,14.1).

5. The installation (50) in accordance with claim 1, characterized in that the conduit system has at least one further conduit branch (24.2) with a further conveying pump (14.2) and a further dispensing head (34.2).

6. A method of using the installation (10, 20, 30, 40, 50, 60) in accordance with claim 1, comprising conveying a liquid from the container to the dispensing head, wherein the liquid conveyed is a dye, an adhesive or a foodstuff component.

7. The installation of claim 1 wherein said intermittently operating pumps are piston pumps.

8. The installation of claim 1 wherein the dispensing heads are adapted to dispense the liquid in the form of length-limited beads or in quasi-continuous form.

9. The installation of claim 1 wherein the conduit systems at least partially consist of flexible conduits, which flexible conduits can optionally be heated or cooled.

* * * * *